US010836153B2

(12) United States Patent
Wei

(10) Patent No.: US 10,836,153 B2
(45) Date of Patent: Nov. 17, 2020

(54) POSITION FINE TUNING DEVICE USED FOR A UNIT-TYPE DIE CUTTING AND HOT STAMPING MACHINE AND A WORKING METHOD THEREOF

(71) Applicant: Tian-Sheng Liu, Taipei (TW)

(72) Inventor: Shu-Yuan Wei, Tianjin (CN)

(73) Assignee: Tian-Sheng Liu, Taipei (TW)

( * ) Notice: Subject to any disclaimer, the term of this patent is extended or adjusted under 35 U.S.C. 154(b) by 0 days.

(21) Appl. No.: 16/660,143

(22) Filed: Oct. 22, 2019

(65) Prior Publication Data

US 2020/0047483 A1 Feb. 13, 2020

Related U.S. Application Data

(62) Division of application No. 15/643,325, filed on Jul. 6, 2017.

(30) Foreign Application Priority Data

Jul. 7, 2016 (CN) ..... 2016 1 0529050

(51) Int. Cl.

| | |
|---|---|
| ***B41F 1/30*** | (2006.01) |
| ***B41F 16/00*** | (2006.01) |
| ***B41F 19/06*** | (2006.01) |
| ***B41F 19/00*** | (2006.01) |

(52) U.S. Cl.

CPC ..... *B41F 16/0026* (2013.01); *B41F 19/008* (2013.01); *B41F 19/068* (2013.01); *B41P 2219/42* (2013.01)

(58) Field of Classification Search

CPC ..... B41F 1/30

USPC ..... 101/485

See application file for complete search history.

(56) References Cited

U.S. PATENT DOCUMENTS 3,591,169 A * 7/1971 Preuss ..... B41F 21/08 271/277
3,847,079 A * 11/1974 Dahlgren ..... B41F 21/08 101/490
4,058,307 A * 11/1977 Bubley ..... B41F 15/22 271/85
4,443,094 A 4/1984 Ricciardi
(Continued)

FOREIGN PATENT DOCUMENTS

CN 1613660 5/2005

*Primary Examiner* — Anthony H Nguyen
(74) *Attorney, Agent, or Firm* — Muncy, Geissler, Olds & Lowe, P.C.

(57) ABSTRACT

A position fine tuning device for a unit-type die cutting & hot stamping machine includes at least two imprinting elements, wherein paper of the imprinting elements is delivered by the gripper installed on the chain. The present invention is characterized in that a positioning element is disposed on an input end of a first unit imprinting element and a positioning element is disposed on an output end of each imprinting element. Two neighboring positioning elements accomplish the positioning between the two positioning elements together. By providing the fine tuning elements, the accuracy in the art of die cutting & hot stamping can be assured when the machine is performing a multiple-working-position procedure; whereas, by setting up the reference positioning, it assures that the standards of the front and rear positioning are consistent.

5 Claims, 10 Drawing Sheets

(56) References Cited

U.S. PATENT DOCUMENTS

| | | | | |
|---|---|---|---|---|
| 4,596,184 | A | 6/1986 | Fischer | |
| 4,846,061 | A * | 7/1989 | Jeschke | B41F 21/04 101/408 |
| 5,125,334 | A | 6/1992 | Marx et al. | |
| 5,193,458 | A | 3/1993 | Keller | |
| 5,566,614 | A | 10/1996 | Ganter | |
| 5,651,235 | A * | 7/1997 | Ashley | B65B 7/01 53/458 |
| 6,260,456 | B1 * | 7/2001 | Schaede | B65H 29/041 83/34 |
| 6,386,816 | B1 * | 5/2002 | Urea | B65H 29/003 101/408 |
| 2004/0089178 | A1 * | 5/2004 | Muller | B41F 21/104 101/408 |
| 2015/0217889 | A1 * | 8/2015 | Nakamoto | B65B 43/50 198/678.1 |
| 2016/0159078 | A1 | 6/2016 | Fujiwara et al. | |

* cited by examiner

POSITION FINE TUNING DEVICE USED FOR A UNIT-TYPE DIE CUTTING AND HOT STAMPING MACHINE AND A WORKING METHOD THEREOF

CROSS REFERENCE TO RELATED APPLICATIONS

This application is a Divisional of co-pending application Ser. No. 15/643,325, filed on 6 Jul. 2017, for which priority is claimed under 35 U.S.C. § 120; and this application claims priority of Application No. 201610529050.8 filed in China on 7 Jul. 2016 under 35 U.S.C. § 119; the entire contents of all of which are hereby incorporated by reference.

BACKGROUND OF THE INVENTION a) Field of the Invention

The present invention relates to the art of printing and a printing machine, and more particularly to a position fine tuning device used for a unit-type die cutting & hot stamping machine and a working method thereof.

b) Description of the Prior Art

For an existing multi-unit die cutting & hot stamping apparatus on the markets (Chinese patent No. ZL 200410093700.6), a multi-unit die pressing element and an aluminum foil control element are employed to accomplish multiple hot stamping (or indenting) and die cutting as required, which increases the production efficiency and shortens the production cycle considerably. However, paper delivered in this kind of apparatus is normally held and transmitted by multiple parallel installed grippers, wherein the grippers hold paper and enter into the workpieces in each unit along a track of closed loop to carry out die pressing. As the closed chain is long and is suffered from a frequent change in the magnitude and direction of tension during a long time of use, the deformation of chain will occur, which greatly reduces the printing accuracy of the apparatus due to the error accumulation of the chain.

For the inevitable printing error caused by the extension error in the chain, no existing positioning device is able to do the fine tuning in time, and the positioning deviation will directly affect the processing accuracy. To guarantee the processing accuracy and quality of paper, the printing apparatus needs to be turned off for adjustment constantly, and this adjustment method will waste time and labor, which reduces the working efficiency of the apparatus and increases the labor cost.

In addition, if the printing apparatus is provided with plural workpieces in a unit, one will normally need to orderly carry out verification and fine tuning to each positioning device of the workpiece. Besides that, the paper positioning method is tedious and inaccurate.

SUMMARY OF THE INVENTION

The primary object of the present invention is to provide a position fine tuning device used for a unit-type die cutting & hot stamping machine and a working method thereof, which are capable of solving the shortcomings in the prior art. The device guarantees that the unit-type die cutting & hot stamping machine can accomplish the operation by delivering paper in one time, improves the operational efficiency and at the same time guarantees the quality of operation. In addition, at the same time when the multi-position operation is accomplished, the operational accuracy is improved through a fine tuning device for positioning. Furthermore, the device is advantageous in consistency in the positioning reference, simplicity in the adjustment method, and optimization in structure features; whereas, the effect of the extension error in the chain can be counteracted by determining the positioning reference and adjusting the distance between the reference surface and the reference matching surface of the position fine tuning device.

The technical means of the present invention discloses a position fine tuning device used for a unit-type die cutting & hot stamping machine. The said unit-type die cutting & hot stamping machine includes at least two imprinting elements, wherein paper of the imprinting elements is delivered by the gripper installed on the chain. The present invention is characterized in that the position fine tuning device includes a positioning element disposed on an input end of a first imprinting element and a positioning element disposed on an output end of each imprinting element. Two neighboring positioning elements accomplish the positioning between the two positioning elements together, and each said positioning element is disposed parallel along the direction of deliver of the chain.

The said imprinting element includes a first unit imprinting element and a second unit imprinting element. The said position fine tuning device includes a front positioning element disposed on an input end of the first unit imprinting element, a first unit rear positioning element disposed on an output end of the first unit imprinting element, and a second unit rear positioning element disposed on an output end of the second unit imprinting element. The front positioning element and the first unit rear positioning element accomplish the front positioning to the first unit imprinting element together, the first unit rear positioning element and the second unit rear positioning element accomplish the rear positioning to the second unit imprinting element together, and the three said positioning elements are parallel disposed along the direction of deliver of the chain.

The said positioning element is constituted by a positioning assembly installed symmetrically on each end of the imprinting element, and the said positioning assembly includes a positioning rod which can rotate against an installation shaft. Each positioning rod is provided with a positioning block, the said positioning block is provided with a reference surface, and the said gripper body on the gripper is provided with a reference matching surface. When an end of the positioning rod swings, the reference surface of the positioning block thereon is in contact with the reference matching surface on the gripper body, thereby carrying out the positioning work.

There are at least three reference matching surfaces, including those that are fixed and connected on the gripper. In addition, the position of at least one reference matching surface is adjustable.

The said reference matching surfaces include the reference matching surface I, the reference matching surface II, and the reference matching surface III. The locations where the reference matching surfaces I, II, III are can be the same or different. Upon accomplishing a various positioning action, the reference surface of the said positioning block match and position with the reference matching surface in a different location. The said reference matching surfaces I, II, III are in contact with the reference surfaces, and by adjusting the locations of the reference matching surfaces I, II, III, paper which is held by the gripper will be guaranteed to be at the working position.

Based upon the first unit rear positioning element, the reference surface of the positioning block matches with the reference matching surface II, and the distance between the reference surface and the reference matching surface II of the positioning block is constant. The reference surface of the positioning block matches and contacts with the reference matching surface I of the front positioning element, and when performing the front positioning work, the thickness of the reference matching surface I is adjusted, allowing paper held by the gripper to be located at the first working position. The reference surface of the positioning block matches with the reference matching surface III of the second unit rear positioning element, and when performing the rear positioning work, the thickness of the reference matching surface III is adjusted, allowing paper held by the gripper to be at the second working position.

The location of the said reference matching surface is adjusted by changing the gasket in a different thickness. The said gasket is fixed and connected with the gripper body, the said reference matching surface is fixed and connected with the gasket, and the said reference matching surface matches with the reference surface of the positioning block. By changing the gasket in a different thickness, the location of the reference matching surface is adjusted, thereby assuring that paper held by the gripper to be at the working position. The location of the reference matching surface can be adjusted by changing the thickness of a gasket to a required size or can be adjusted by providing plural gaskets in a different thickness.

The location of the said reference matching surface is adjusted by rotating the adjusting pin toward right or left. The said adjusting pin is connected with a thread of the gripper body, the said reference matching surface is fixed and connected with the adjusting pin, and the said reference matching surface matches with the reference surface of the positioning block. The said adjusting pin is locked tightly through a nut, and by rotating the nut, the adjusting pin can move toward right or left, thereby adjusting the location of the reference matching surface, so as to assure that paper held by the gripper is at the working position.

Two ends of the said gripper are fixed on two transmission chains which are closed and parallel to each other. The gripper body of the gripper is fixed and connected with the chain through a connecting block.

The said imprinting element includes a fixed platform and a movable platform. The fixed platform and the movable platform of each imprinting element can be installed with a die cutting or indenting tool to implement paper cutting and indenting.

The imprinting element in the said unit-type die cutting & hot stamping machine for accomplishing the hot stamping procedure includes an aluminum foil control element, constituting a hot foil stamping control element. The said hot foil stamping control element can be added to the aluminum foil control element transversally.

The fixed platform of the said imprinting element is installed with a heating system and a hot foil stamping tool to implement hot stamping.

The said chain is connected with tensioners.

A working method of the position fine tuning device used for the unit-type die cutting & hot stamping machine is characterized in following steps:

(1) Selecting a positioning element as a positioning reference, meaning that the matching of the reference surface of the positioning block on the positioning rod with the reference matching surface on the gripper body of that positioning element is used as the positioning reference;

(2) Adjusting other positioning elements to accomplish positioning, meaning that the distance between the reference surface of the positioning block on the positioning rod and the reference matching surface on the gripper body in each positioning element is adjusted, assuring that the distance between two neighboring grippers is constant to accomplish positioning.

For fine tuning the distance between the said reference matching surface and the positioning block, the adjusting pin can be adjusted toward right or left to adjust the location of the reference matching surface on the adjusting pin, thereby adjusting paper to be at the working position; or, the location of the reference matching surface on the gasket can be adjusted by changing the gasket in a different thickness, thereby adjusting paper to be at the working position.

After being transmitted from the delivering element to a conveyor, paper is positioned by a positioning front guide on the conveyor. A front edge of the paper after being positioned is held by the gripper, assuring that each working position of paper relative to the gripper is kept constant. The paper that is held tightly by the gripper is transmitted to a subsequent working table for the following hot stamping.

The gripper sheet of the gripper body of the said gripper holds and moves paper to a working position for processing. The positioning rod swings, and the gripper body and the connecting block ascend. When the positioning rod rotates to an end to contact with the reference matching surface of the connecting block, the initial positioning to the gripper is accomplished. The reference positioning is accomplished when the positioning block of the positioning element acting as the positioning reference is in contact with the corresponding reference matching surface; whereas, the positioning is accomplished by adjusting the distance between the positioning block and the corresponding reference matching surface of other positioning elements. Therefore, the precision positioning to all the imprinting elements is accomplished simultaneously. At this time, the paper imprinting procedure at each imprinting element starts. After accomplishing the paper processing, the positioning rod rotates counterclockwise, and the gripper body and the connecting block descend. At this time, the reference matching surface of the positioning block of the chain escapes from a positioning roller. When the positioning rod descends to the lowest point, the positioning rod will escape completely from the reference matching surface of the connecting block, and the gripper will hold and move paper to a next working position.

With the said imprinting element including the first unit imprinting element and the second unit imprinting element as an example, the gripper is provided with the reference matching surfaces I, II, III. The front positioning element disposed on the input end of the first unit imprinting element, the first unit rear positioning element disposed on the output end of the first unit imprinting element, and the second unit rear positioning element disposed on the output end of the second unit imprinting element are provided respectively with a positioning block. The reference surface of the positioning block matches and positions with the reference matching surface I, the reference matching surface II, the reference matching surface III in a different location, respectively.

The positioning block matches with the reference matching surface II of the first unit rear positioning element, acting as a positioning reference. The positioning block matches with the reference matching surface I of the front positioning element, and the location of the reference matching surface I adjusted, which implements the front positioning to the first unit imprinting element by allowing the gripper to hold and move paper to the working position. The positioning block matches with the reference matching surface III of the second unit rear positioning element, and the location of the reference matching surface III is adjusted, which implements the rear positioning to the second unit imprinting element by allowing the gripper to hold and move paper to the working position.

The present invention is provided with the following advantages that:

(1) By providing the fine tuning elements on the multi-unit die cutting & hot stamping machine for accurate positioning, the accuracy in the art of die cutting & hot stamping can be assured; whereas, at the same time, the working efficiency can be improved when the machine is performing a multiple-working-position procedure.

(2) By using the front position fine tuning method and the rear position fine tuning method to the positioning elements, the reference positioning is set up, which assures that the standards of the front and rear positioning are be consistent, such that the unit-type die cutting & hot stamping machine can be provided with the advantages in a consistent positioning reference, a simple adjustment method and optimization in structures.

(3) The position fine tuning method is simple that the reference positioning, the front positioning and the rear positioning can be implemented only by changing the gasket in a different thickness or rotating the adjusting pin toward right or left to adjust the location of the reference matching surface that matches with the reference matching surface of the positioning block.

(4) The positioning rod is designed separately from the positioning block having a high accurate reference surface. This kind of assembly-type design solution facilitates serial production and optimization in the production procedure. In addition, the reference surface after wearing in the positioning procedure can be replaced easily, and the positioning block can facilitate processing into the reference surface that requires a higher accuracy.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

In the present embodiment, a double-unit imprinting element is used as an example for description and is only used to allow a person in this technical field to understand the present invention more comprehensively, without limiting the present invention in any way of restriction.

Figure 1:
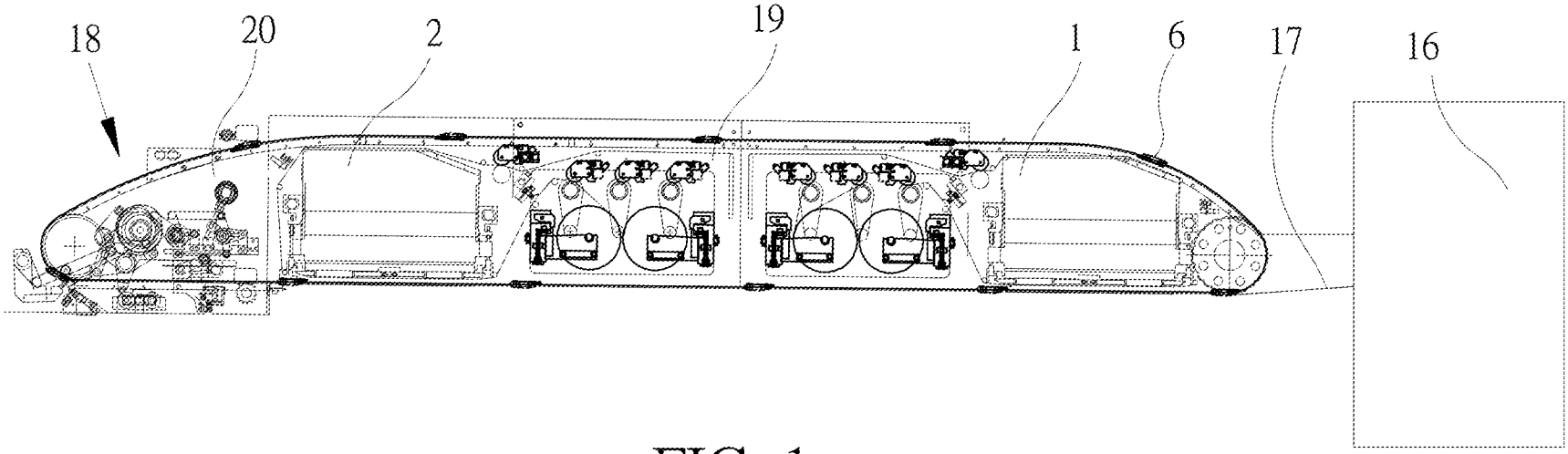
FIG. 1 shows a schematic view of a position fine tuning device used for a unit-type die cutting & hot stamping machine, according to the present invention.
Figure 2:
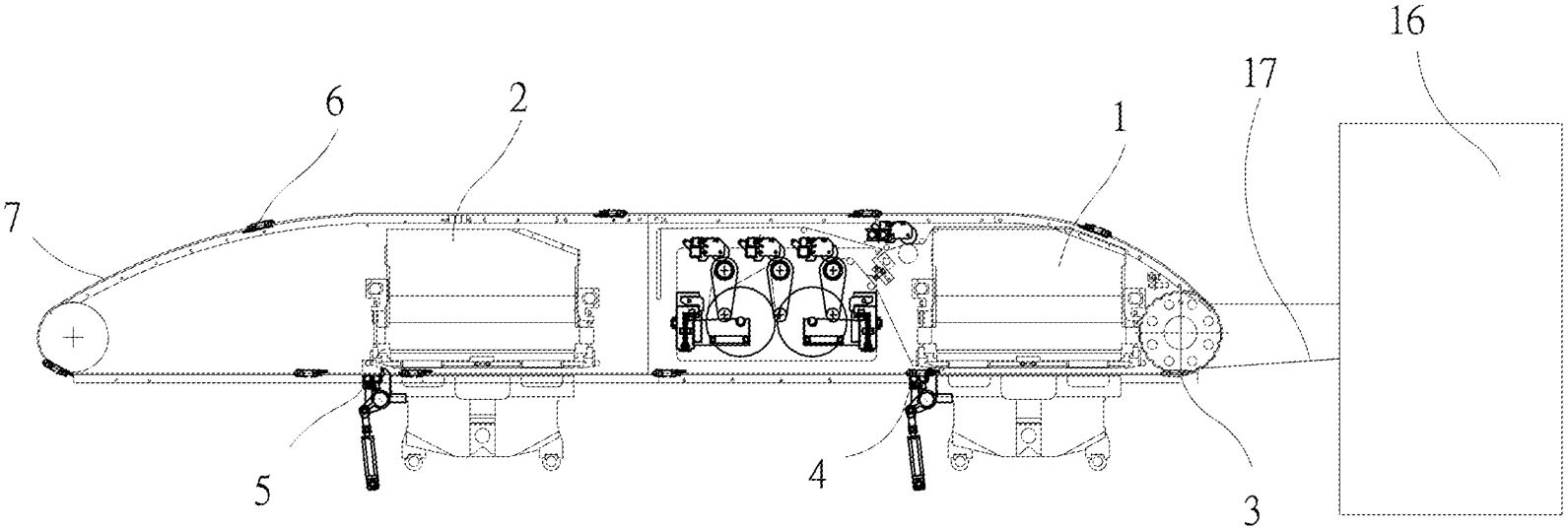
FIG. 2 shows another schematic view of the position fine tuning device used for a unit-type die cutting & hot stamping machine, according to the present invention.

Referring to FIG. 1 and FIG. 2, a position fine tuning device used for a unit-type die cutting & hot stamping machine comprises a paper delivering element 16, an imprinting element and a paper receiving element 20. These parts are carried and surrounded commonly by a casing 18.

Paper 17 for imprinting is delivered by a gripper 6 installed on chains 8. Two ends of the said gripper 6 are fixed on two transmission chains 8 which are closed and parallel to each other, a grip body 11 of the gripper 6 and the chain 8 are fixed and connected through a connecting block 10 (as shown in FIGS. 1 to 4).

The said imprinting element includes a fixed platform and a movable platform. The fixed platform and the movable platform of each imprinting element can be installed with a die cutting or indenting tool to implement paper cutting and indenting (as shown in FIG. 1 and FIG. 2).

The imprinting element in the said unit-type die cutting & hot stamping machine for accomplishing the hot stamping procedure includes an aluminum foil control element, constituting a hot foil stamping control element. The said hot foil stamping control element can be added to the aluminum foil control element transversally (as shown in FIG. 1 and FIG. 2).

The fixed platform of the said imprinting element is installed with a heating system and a hot foil stamping tool to implement the hot stamping function (as shown in FIG. 1 and FIG. 2).

Figure 3:
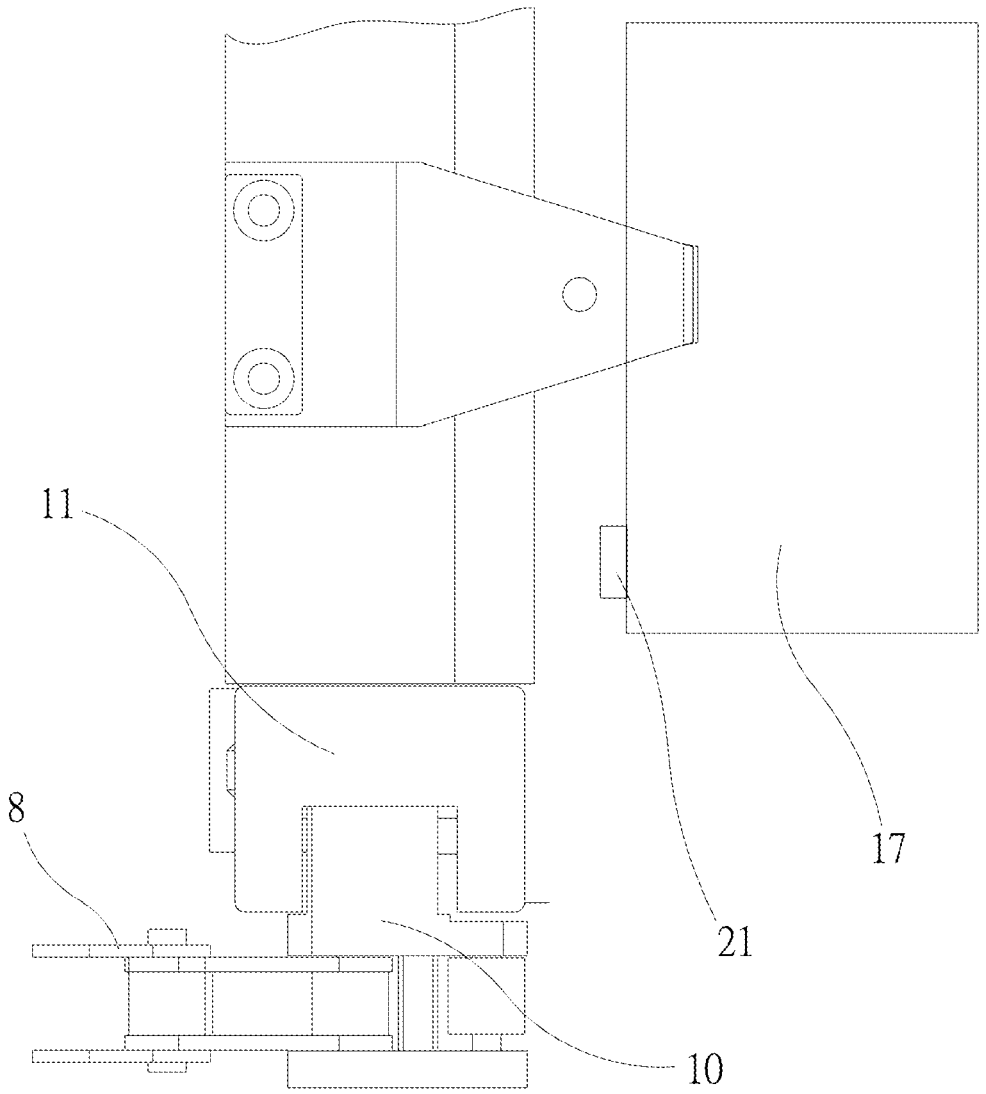
FIG. 3 shows a schematic view of a positioning relationship between a gripper and paper, according to the unit-type die cutting & hot stamping machine of the present invention.
Figure 4:
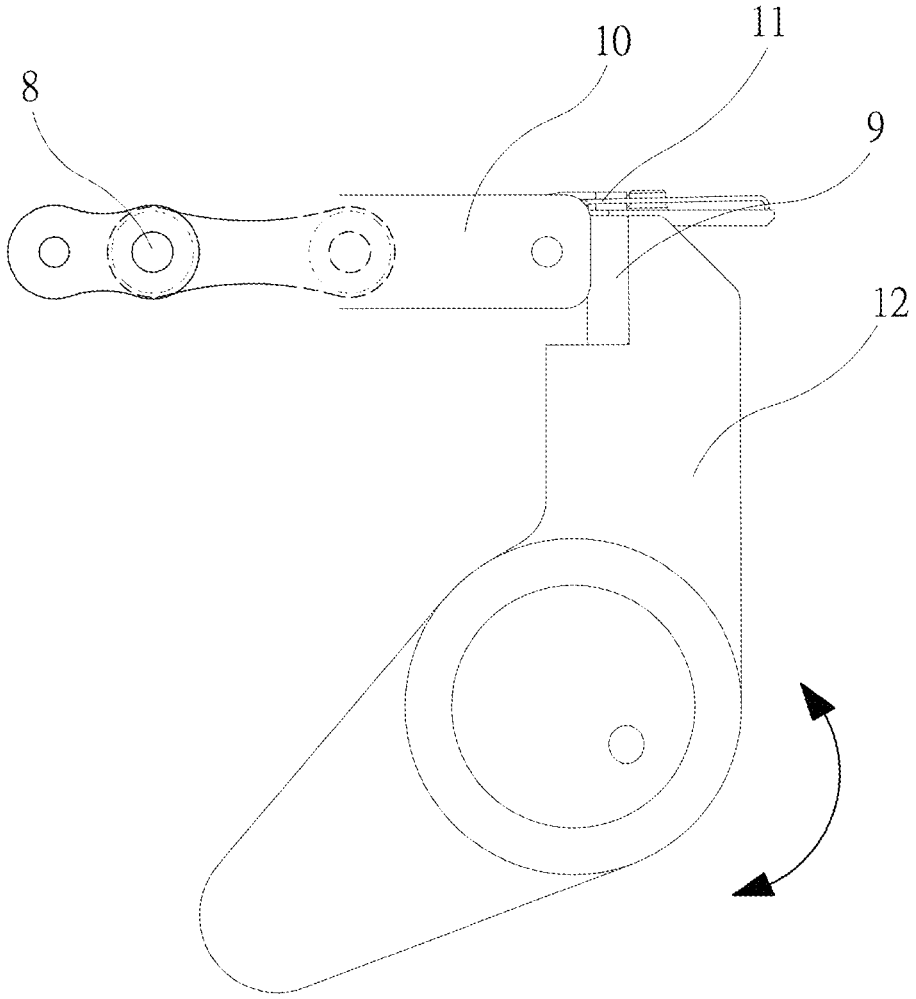
FIG. 4 shows a front view of the position fine tuning device of the present invention.

The said chain 8 is connected with tensioners 7 (as shown in FIGS. 2 to 4).

With the imprinting element of the unit-type die cutting & hot stamping machine including a first unit imprinting element 1 and a second unit imprinting element 2 as an example, the said imprinting element is provided with a position fine tuning device. The said imprinting element includes a first unit imprinting element, and a second unit imprinting element. The said position fine tuning device includes a front positioning element 3 disposed on an input end of the first unit imprinting element 1, a first unit rear positioning element 4 disposed on an output end of the first unit imprinting element 1, and a second unit rear positioning element 5 disposed on an output end of the second unit imprinting element 2. The front positioning element 3 and the first unit rear positioning element 4 accomplish the front positioning to the first unit imprinting element 1 together, the first unit rear positioning element 4 and the second unit rear positioning element 5 accomplish the rear positioning to the second unit imprinting element 2 together, and the three said positioning elements are disposed parallel along the direction of deliver of the chain (as shown in FIG. 2).

In the fine tuning process of the imprinting elements, one of the three positioning elements (the front positioning element 3, the first unit rear positioning element 4, and the second unit rear positioning element 5) is used as a reference, and the distance between the other two positioning elements and the reference positioning element is adjusted.

Using the first unit rear positioning element 4 as an example, the structure configurations for the three positioning elements are shown in FIGS. 2 to 10.

The front positioning element 3 is constituted by a positioning assembly installed symmetrically at each end of the imprinting element.

The said positioning assembly includes a positioning rod 12 which can rotate against an installation shaft, as well as a gripper body 11 of the gripper 6. The said gripper body 11 is provided with a reference matching surface I A, and the said positioning rod 12 is provided with a positioning block 9. The said positioning block 9 is provided with a reference surface, and the reference surface of the positioning block 9 matches and positions with the reference matching surface I A of the gripper body 11.

The first unit rear positioning element 4 is constituted by a positioning assembly installed symmetrically at each end of the imprinting element. The said positioning assembly includes a positioning rod 12 which can rotate against an installation shaft, as well as a gripper body 11 of the gripper 6. The said gripper body 11 is provided with a reference matching surface II B, and the said positioning rod 12 is provided with a positioning block 9. The said positioning block 9 is provided with a reference surface, and the reference surface of the positioning block 9 matches and positions with the reference matching surface II B of the gripper body 11.

The second unit rear positioning element 5 is constituted by a positioning assembly installed symmetrically at each end of the imprinting element. The said positioning assembly includes a positioning rod 12 which can rotate against an installation shaft, as well as a gripper body 11 of the gripper 6. The said gripper body 11 is provided with a reference matching surface III C, and the said positioning rod 12 is provided with a positioning block 9. The said positioning block 9 is provided with a reference surface, and the reference surface of the positioning block 9 matches and positions with the reference matching surface III C of the gripper body 11.

The surface on which the reference matching surface II B of the first unit rear positioning element 4 matches with the positioning block 9 at that location is the reference surface.

Figure 5:
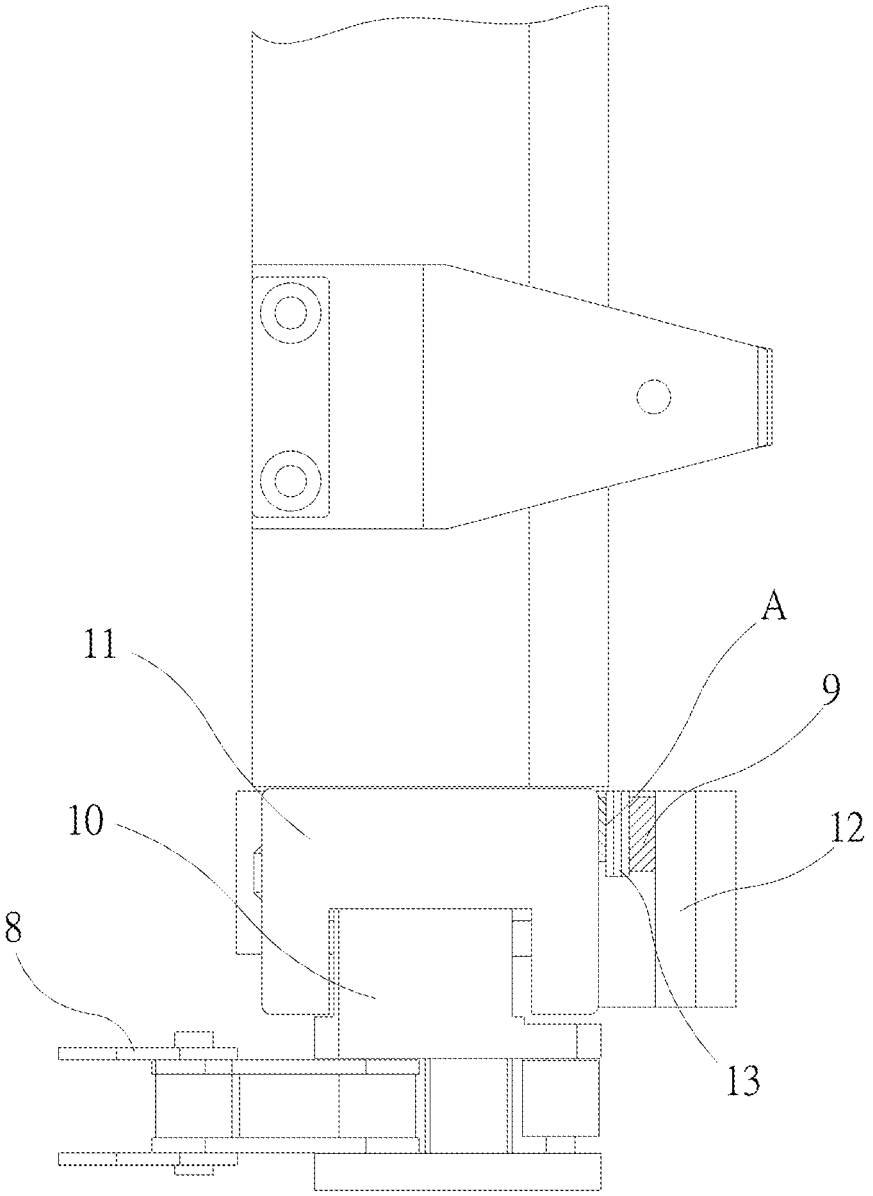
FIGS. 5 to 7 show top views of the position fine tuning device of the present invention that the distance is adjusted by changing a gasket.
Figure 6:
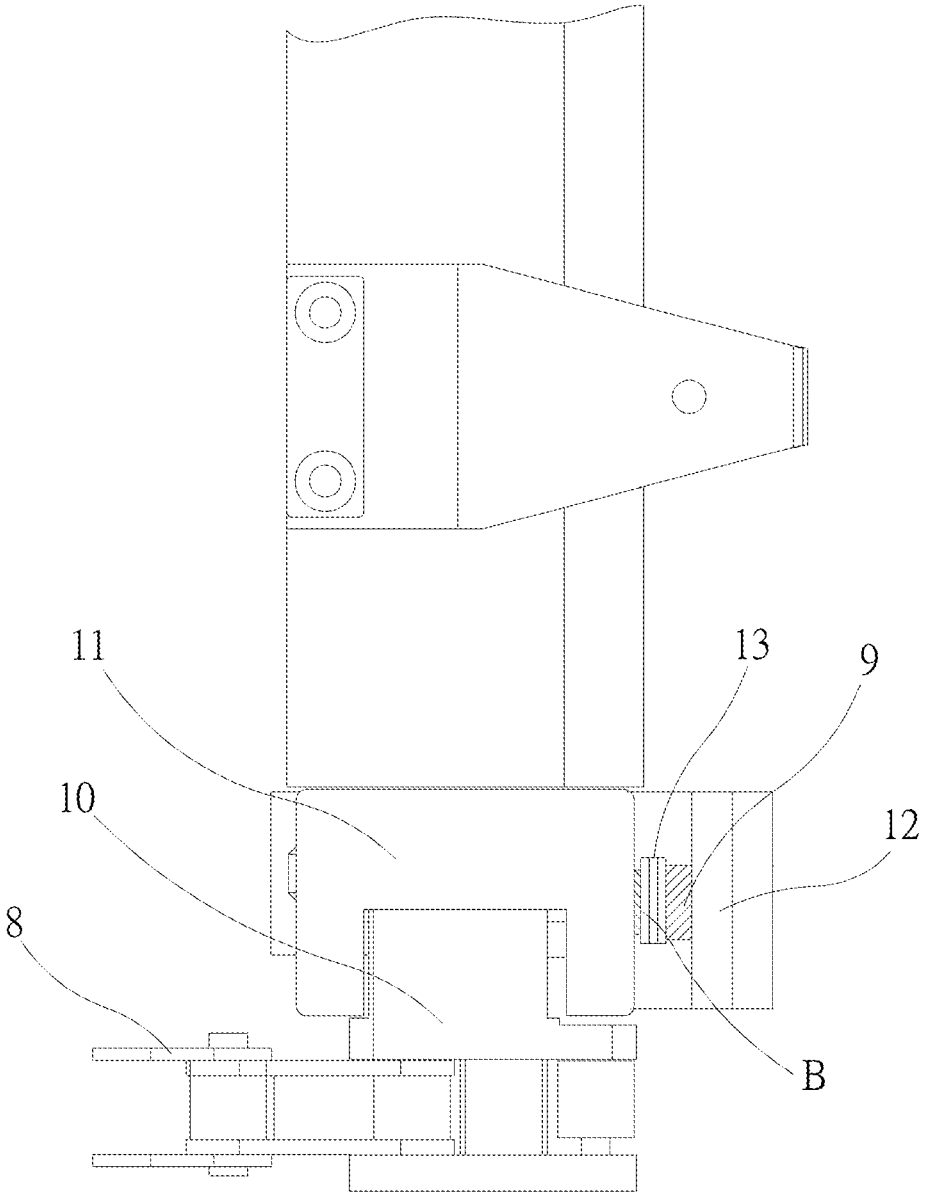
Figure 7:
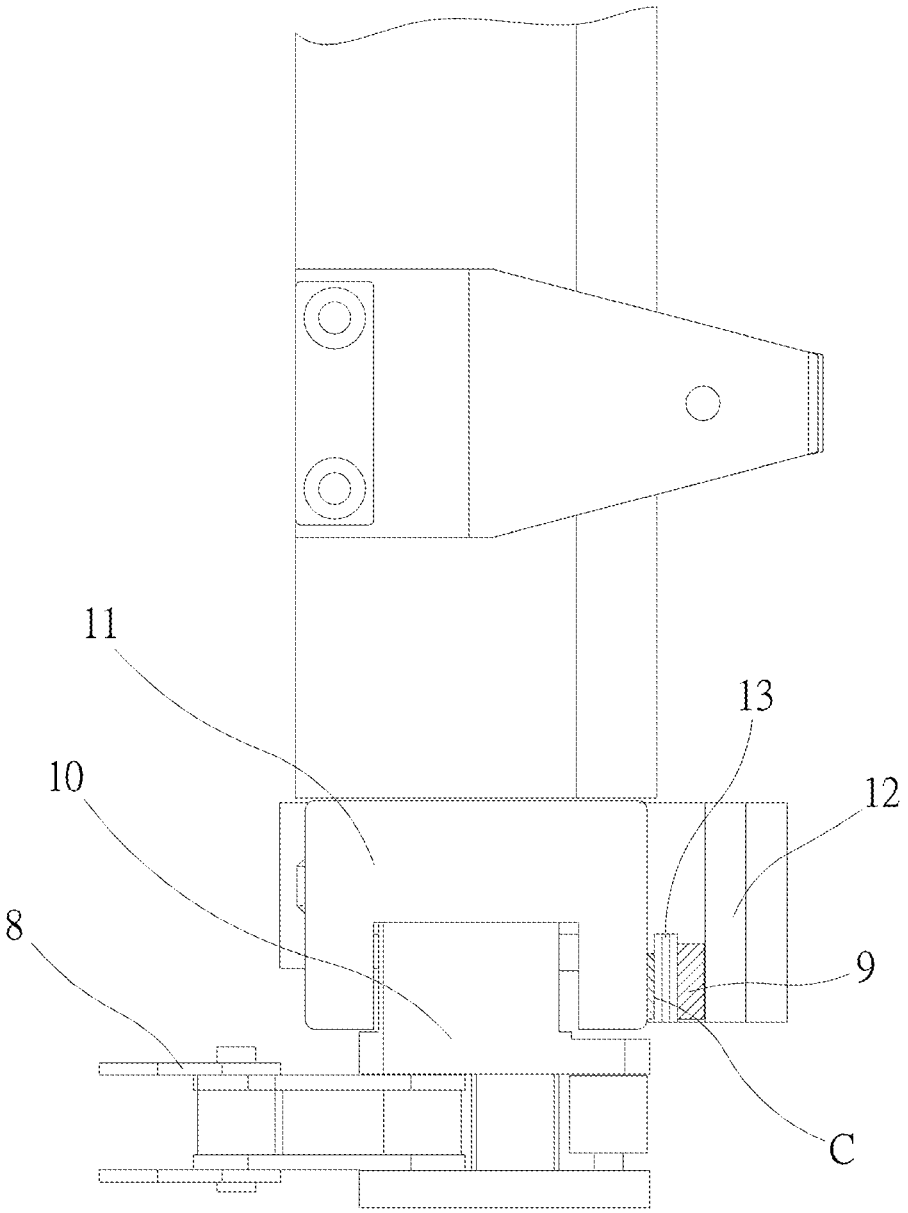

A first embodiment of adjusting the reference matching surface is shown in FIGS. 5 to 7. Upon carrying out the position fine tuning work, the distance between the reference surface and the reference matching surface II B of the reference positioning element (i.e., the first unit rear positioning element 4) is constant. By changing the gasket 13 on the reference matching surface I A, the location of the reference matching surface I A is adjusted to accomplish front positioning. By changing the gasket on the reference matching surface III C, the location of the reference matching surface III C is adjusted to accomplish rear positioning.

Figure 8:
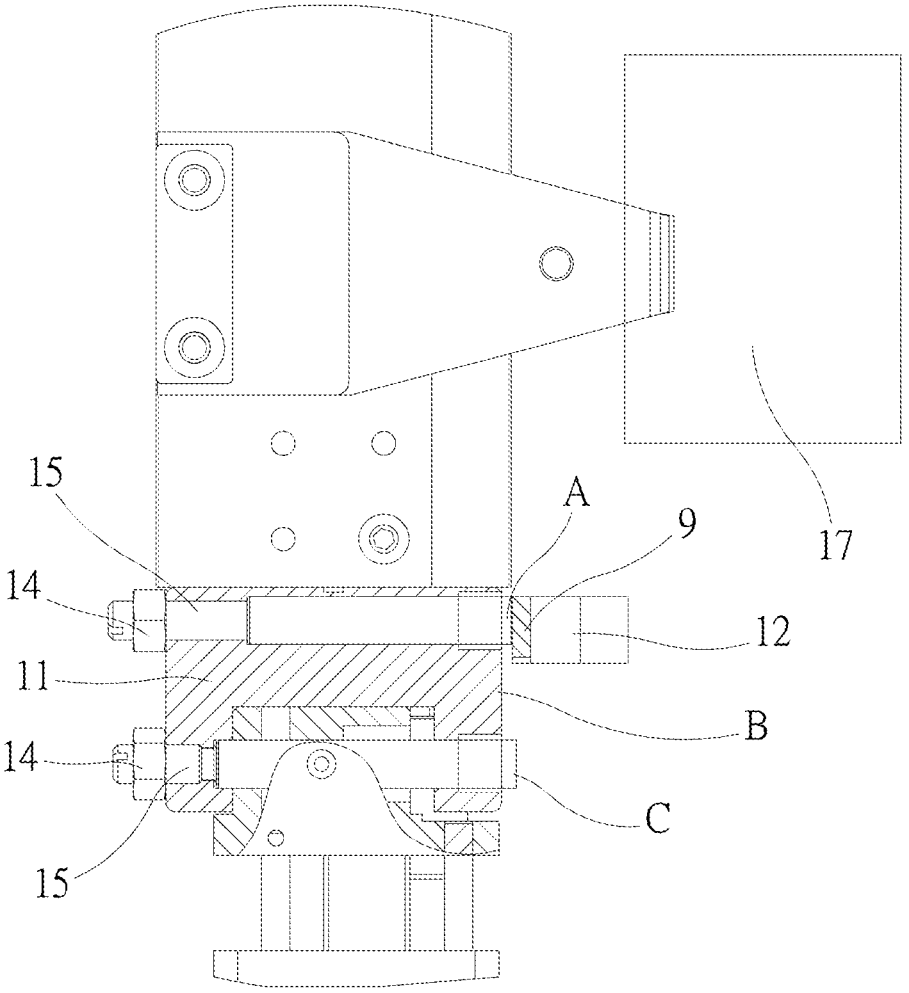
FIGS. 8 to 10 show top views of the position fine tuning device of the present invention that the distance is adjusted by an adjusting pin.
Figure 9:
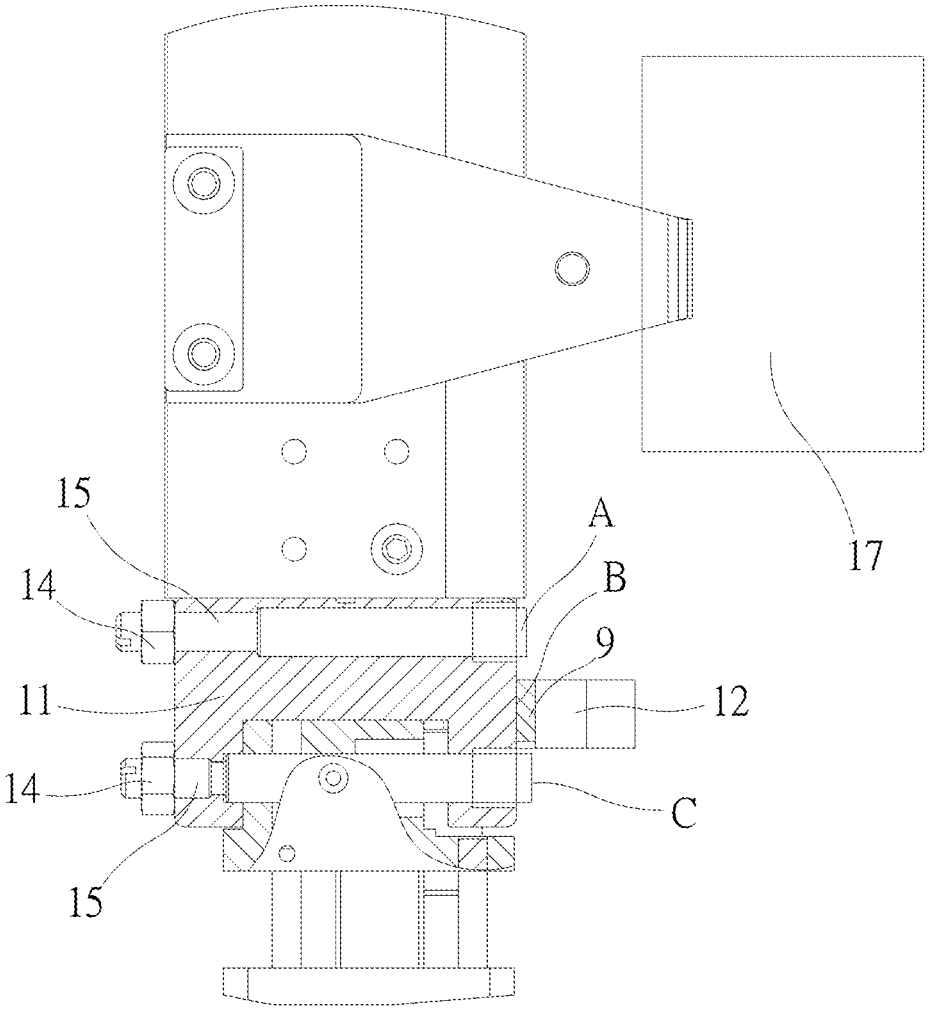
Figure 10:
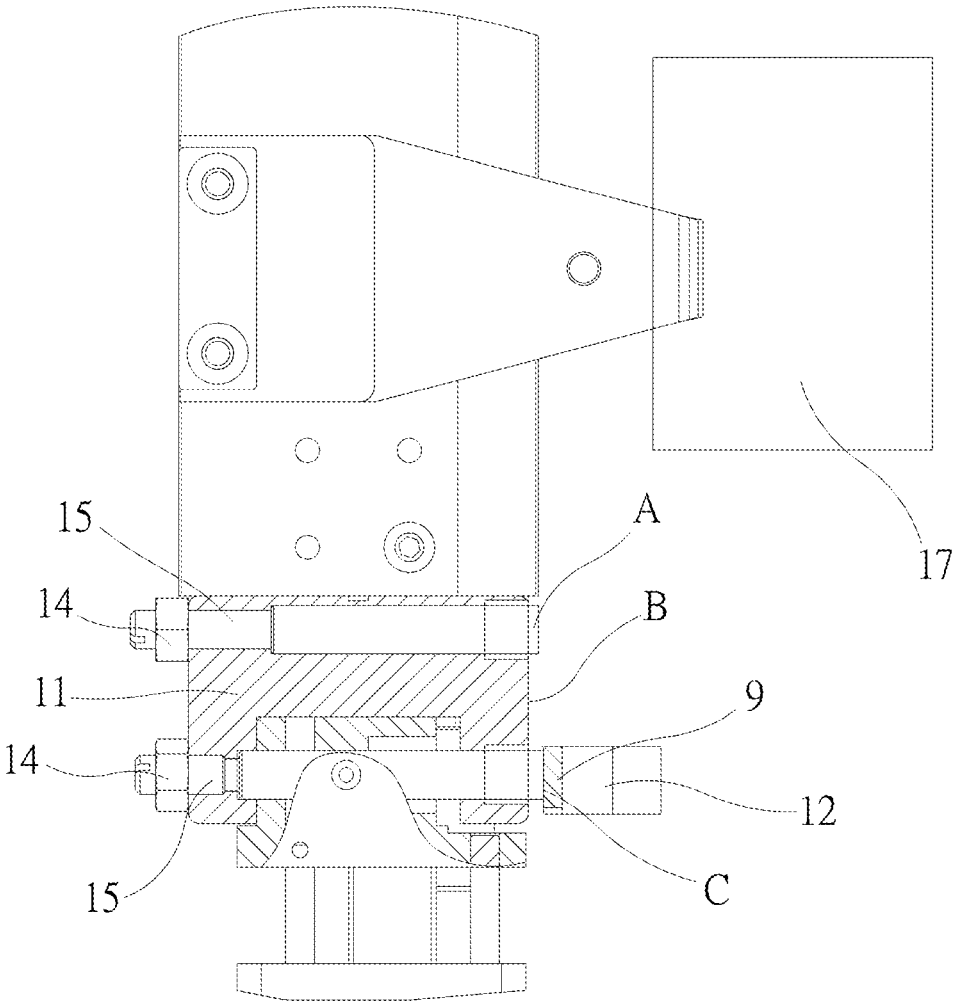

A second embodiment of adjusting the reference matching surface is shown in FIGS. 8 to 10. The gripper body 11 is provided with through-holes and each of the said through-holes is installed with an adjusting pin 15. The said adjusting pin 15 is locked tightly by a tightening nut 14. Upon carrying out the position fine tuning work, tightening nut 14 is adjusted to adjust the location of the reference matching surface of the adjusting pin 15, which assures that paper held by the gripper will be aligned with the reference surface to locate at the working position, thereby accomplishing the positioning work.

As shown in FIG. 2, for an example, using the first unit rear positioning element 4 as the reference positioning, the reference matching surface II B of the gasket matches and contacts with the reference surface of the positioning block at that location, forming a reference positioning surface.

Upon carrying out the position fine tuning work, the front positioning element 3 and the second unit rear positioning element 5 are adjusted respectively, in accordance with the reference positioning surface. Referring to FIG. 2 and FIG. 8, by adjusting the tightening nut 14, the reference matching surface I A of the adjusting pin 15 is made to move toward paper, thereby accomplishing the front positioning work. As shown in FIG. 9, by adjusting the tightening nut 14, the reference matching surface III C of the adjusting pin 15 is made to move away from paper, thereby accomplishing the rear positioning work. By assuring the distance between two positioning elements to be constant, paper of each positioning element can be guaranteed to reach the established working position.

The present invention also discloses a working method of the position fine tuning device used for the unit-type die cutting & hot stamping machine. The working method is characterized in following steps:

(1) Selecting a positioning element as a positioning reference, meaning that the tightly contact of the reference surface of the positioning block 9 on the positioning rod with the reference matching surface of the gripper 6 of that positioning element is used as the positioning reference;

(2) Adjusting other positioning elements to accomplish positioning, meaning that the distance between the positioning block 9 on the positioning rod 12 and the corresponding reference matching surface on the gripper 6 in each positioning element is adjusted, assuring that the distance between two neighboring grippers 6 is constant to accomplish positioning.

For fine tuning the distance between the said reference matching surface and the positioning block 9, by changing the gasket in a different thickness, the location of the reference matching surface on the gasket is adjusted, so that paper can be adjusted to be located at the working position; or, the adjusting pin can be adjusted toward right or left to adjust the location of the reference matching surface on the adjusting pin, thereby adjusting paper to be located at the working position.

After being transmitted from the delivering element 16 to a conveyor, paper is positioned by a positioning front guide 21 on the conveyor. A front edge of the paper after being positioned is held by the gripper 6, assuring that each working position of paper relative to the gripper 6 is kept constant. The paper that is held tightly by the gripper 6 is transmitted to a subsequent working table for the following hot stamping.

Each gripper sheet of the gripper body 11 of the said gripper 6 holds and moves paper to a working position for processing. The positioning rod 12 rotates counterclockwise, and the gripper body 11 and the connecting block 10 ascend. When the positioning rod 12 rotates to an end to contact with the reference matching surface of the connecting block 10, the initial positioning to the gripper 6 is accomplished. The reference positioning is accomplished when the reference surface contacts and matches with the reference matching surface II B of first unit rear positioning element 4; whereas, the front positioning to the first unit imprinting element 1 is accomplished by adjusting the distance between the positioning block and the reference matching surface I A of the front positioning element 3 to compensate for the deformation error of the chain 8 caused by extension and assure the distance between the front gripper 6 and the rear gripper 6 of the first unit imprinting element 1 to be constant. At the same time, the rear positioning to the second unit imprinting element 2 is accomplished by adjusting the distance between the positioning block and the reference matching surface III C of the second unit rear positioning element 5 to assure that the distance between the front gripper 6 and the rear gripper 6 of the second unit imprinting element 2 is constant. Therefore, the precision positioning to two imprinting elements is accomplished simultaneously, and at this time, two paper imprinting procedures start. After accomplishing the paper processing, the positioning rod 12 rotates clockwise, and the gripper body 11 and the connecting block 10 descend. At this time, the reference matching surface of the positioning block of the chain 8 escapes from a positioning roller. When the positioning rod 12 descends to the lowest point, the positioning rod 12 will escape completely from the reference matching surface, and the gripper 6 will hold and move paper to a next working position.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A working method of a position fine tuning device used for a unit-type die cutting and hot stamping machine having two imprinting elements, and paper of the imprinting elements being delivered by a gripper of positioning elements installed on a chain, comprising following steps:

a) selecting a first positioning element as a positioning reference, the positioning reference being determined by matching between a reference surface of a positioning block on a positioning rod and a reference matching surface on the gripper of the first positioning element;

b) adjusting a distance between the reference surface of the positioning block on the positioning rod and the reference matching surface on a gripper body of the gripper in each of second positioning elements to assure that a distance between two of the grippers of the first positioning element and the second positioning elements is constant, thereby accomplishing a positioning work, wherein the position fine tuning device comprises a positioning element disposed on an input end of a first imprinting element and a positioning element disposed on an output end of each imprinting element, with the positioning element disposed on the input end of the first imprinting element and the positioning element disposed on the output end of the each imprinting element accomplishing the positioning between the two positioning elements together.

2. The working method of the position fine tuning device used for a unit-type die cutting and hot stamping machine, according to claim 1, wherein for fine tuning the distance between the reference matching surface and the positioning block, a location of the reference matching surface on an adjusting pin is adjusted to adjust the paper to be located at a working position, by adjusting the adjusting pin laterally relative to the paper to be located.

3. The working method of the position fine tuning device used for a unit-type die cutting and hot stamping machine, according to claim 1, wherein a gripper sheet of the gripper body of the gripper holds and moves the paper to a working position for processing, the positioning rod rotates, and the gripper body and a connecting block ascend; when the positioning rod rotates to an end to contact with the reference matching surface of the connecting block, an initial positioning to the gripper being accomplished; the reference positioning being accomplished when the positioning block of the positioning element acting as the positioning reference is in contact with the corresponding reference matching surface; the positioning being accomplished by adjusting the distance between the positioning block and the corresponding reference matching surface of other positioning elements; the precision positioning to all the imprinting elements being accomplished simultaneously, and at this time, a paper imprinting procedure at each imprinting element starting; after accomplishing the paper imprinting procedure, the positioning rod rotating counterclockwise, and the gripper body and the connecting block descending, whereas at this time, the reference matching surface of the positioning block of a chain escaping from the positioning rod; when the positioning rod descending to the lowest point, the positioning rod escaping completely from the reference matching surface of the connecting block, and the gripper holding and moving paper to a next working position.

4. The working method of the position fine tuning device used for a unit-type die cutting and hot stamping machine, according to claim 3, wherein in after being transmitted from a delivering element to a conveyor, the paper is positioned by a positioning front guide on the conveyor, a front edge of the paper after being positioned is held by the gripper to assure that each working position of the paper relative to the gripper is kept constant, and the paper that is held tightly by the gripper is transmitted to a subsequent working table for a subsequent hot stamping.

5. The working method of the position fine tuning device used for a unit-type die cutting and hot stamping machine, according to claim 1, wherein for fine tuning the distance between the reference matching surface and the positioning block, by changing a gasket in a different thickness, the location of the reference matching surface on the gasket being adjusted to adjust paper to be located at a working position.

* * * * *